US009706848B2

(12) United States Patent
Shih

(10) Patent No.: US 9,706,848 B2
(45) Date of Patent: Jul. 18, 2017

(54) WAIST SUPPORTING DEVICE EQUIPPED ELECTRIC APPARATUS FOR LYING AND/OR SITTING

(75) Inventor: Chuan-Hang Shih, Changhua County (TW)

(73) Assignees: RUOEY LUNG ENTERPRISE CORP., Lu-Kang Town, Changhua County (TW); PPJ.LLC, Natick, MA (US)

( * ) Notice: Subject to any disclaimer, the term of this patent is extended or adjusted under 35 U.S.C. 154(b) by 179 days.

(21) Appl. No.: 13/408,277

(22) Filed: Feb. 29, 2012

(65) Prior Publication Data

US 2013/0145553 A1 Jun. 13, 2013

(30) Foreign Application Priority Data

Dec. 7, 2011 (TW) ..... 100223103 U

(51) Int. Cl.
*A47C 7/46* (2006.01)
*A61G 7/015* (2006.01)

(52) U.S. Cl.
CPC ..... *A47C 7/462* (2013.01); *A61G 7/015* (2013.01)

(58) Field of Classification Search
CPC ..... A61G 7/015; A61G 7/065; A47C 7/462
USPC ..... 5/612, 933, 934, 613, 617; 297/284.4, 297/84.8
See application file for complete search history.

(56) References Cited

U.S. PATENT DOCUMENTS

| | | | | |
|---|---|---|---|---|
| 4,996,731 | A * | 3/1991 | Kruyt | 5/618 |
| 5,133,741 | A * | 7/1992 | Filho | 606/242 |
| 6,874,182 | B2 * | 4/2005 | L'Hegarat et al. | 5/612 |
| 7,159,255 | B2 * | 1/2007 | Piraino | 5/238 |
| 7,293,309 | B1 * | 11/2007 | Shih | 5/618 |
| 7,448,100 | B1 * | 11/2008 | Shih | 5/600 |
| 7,540,048 | B2 * | 6/2009 | Piraino | 5/613 |
| 8,678,495 | B2 * | 3/2014 | Omori et al. | 297/216.12 |
| 2004/0098805 | A1 * | 5/2004 | Piraino | 5/613 |
| 2006/0103204 | A1 * | 5/2006 | Walker et al. | 297/284.4 |
| 2007/0080570 | A1 * | 4/2007 | Kohl et al. | 297/284.4 |
| 2007/0214571 | A1 * | 9/2007 | Piraino | 5/616 |
| 2009/0079245 | A1 * | 3/2009 | Marcantoni | 297/284.4 |
| 2009/0146476 | A1 * | 6/2009 | Kan et al. | 297/284.4 |
| 2009/0178201 | A1 * | 7/2009 | Lujan | A47C 20/027 5/618 |
| 2011/0094032 | A1 * | 4/2011 | Shih | 5/614 |

(Continued)

*Primary Examiner* — Robert G. Santos
*Assistant Examiner* — Myles Throop
(74) *Attorney, Agent, or Firm* — Patent Portfolio Builders PLLC

(57) ABSTRACT

An electric bed, chair and the like includes a back frame, a waist supporting device pivotally connected with the back frame, and an actuator pivotally connected between the back frame and the waist supporting device in such a way that the waist supporting device is turnable by the actuator between a first position and a second position where the waist supporting device protrudes over a top surface of the back frame. The back frame supports a user's back and the waist supporting device can optionally support the user's waist to make the user feel comfortable when he/she lies or sits down. By controlling the actuator, the service of the waist supporting device can be optimally provided and the elevation protruding over the top surface of the back frame can be adjusted so as to adjust the supporting effect of the waist supporting device.

14 Claims, 5 Drawing Sheets

(56) References Cited

U.S. PATENT DOCUMENTS

| | | | | |
|---|---|---|---|---|
| 2013/0042412 | A1* | 2/2013 | Shih | 5/693 |
| 2013/0062921 | A1* | 3/2013 | Meyer et al. | 297/284.8 |
| 2014/0000033 | A1* | 1/2014 | Clenet et al. | 5/618 |
| 2014/0097654 | A1* | 4/2014 | Jenkins | 297/284.4 |
| 2014/0259409 | A1* | 9/2014 | Shih | 5/600 |

* cited by examiner

WAIST SUPPORTING DEVICE EQUIPPED ELECTRIC APPARATUS FOR LYING AND/OR SITTING

BACKGROUND OF THE INVENTION

1. Field of the Invention

The present invention relates generally to apparatuses for lying and/or sitting, such as beds, chairs and the like on which a user's back is able to rest, and more particularly to an electric apparatus for lying and/or sitting, which is equipped with a waist supporting device.

2. Description of the Related Art

Many kinds of beds or chairs, such as a chair having a fixed back, a chair having an inclination adjustable back for providing a bed-like function, or a foldable bed that can be folded upwardly and inclinedly for providing a chair-like function, can provide a support to a user's back when the user sits or lies down thereon. In these conventional beds or chairs, some of them are equipped with a protrusion for supporting the user's waist so as to make the user feel more comfortable when he/she sits down. Because the aforesaid protrusions for the conventional beds or chairs are usually fixedly provided or integrally formed, they can be hardly detached from the beds or chairs when the user does not need the waist support. Some of the conventional protrusions are designed to be detachably mounted on the beds or chairs, such that they can be easily dismantled. However, these detachable protrusions generally have a fixed height and the protruding extents of these detachable protrusions are usually not adjustable by the user, resulting in that the waist supporting effects provided by these attachable protrusions are preset and unchangeable. Therefore, it is desired to provide an apparatus for lying and sitting, which can offer an improved waist supporting effect.

SUMMARY OF THE INVENTION

The present invention has been accomplished in view of the above-noted circumstances. It is therefore the primary objective of the present invention to provide an electric apparatus for lying and/or sitting, which has a waist supporting device cable of being positioned protruding over or flush with a surface on which a user's back leans according to the user's operation.

Another objective of the present invention is to provide an apparatus for lying and/or sitting, which has a waist supporting device that can be operated by a user to adjust its elevation that protrudes over the surface on which the user's back leans so as to adjust the waist supporting effect thereof.

To achieve the above-mentioned objectives, the electric apparatus for lying and/or sitting provided by the present invention comprises a back frame having a top surface, a waist supporting device pivotally connected with the back frame, and an actuator having a fixation end pivotally connected with one of the back frame and the waist supporting device, and a reciprocally retractable end pivotally connected with the other one of the back frame and the waist supporting device. The waist supporting device is drivenable by the actuator to swivel between a first position and a second position where the waist supporting device protrudes over the top surface of the back frame.

The electric apparatus for lying and/or sitting may be, but not limited to, an electric bed or an electric chair. Preferably, the electric apparatus is realized as an electric bed.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below and the accompanying drawings which are given by way of illustration only, and thus are not limitative of the present invention, and wherein.

DETAILED DESCRIPTION OF THE INVENTION

Figure 1:
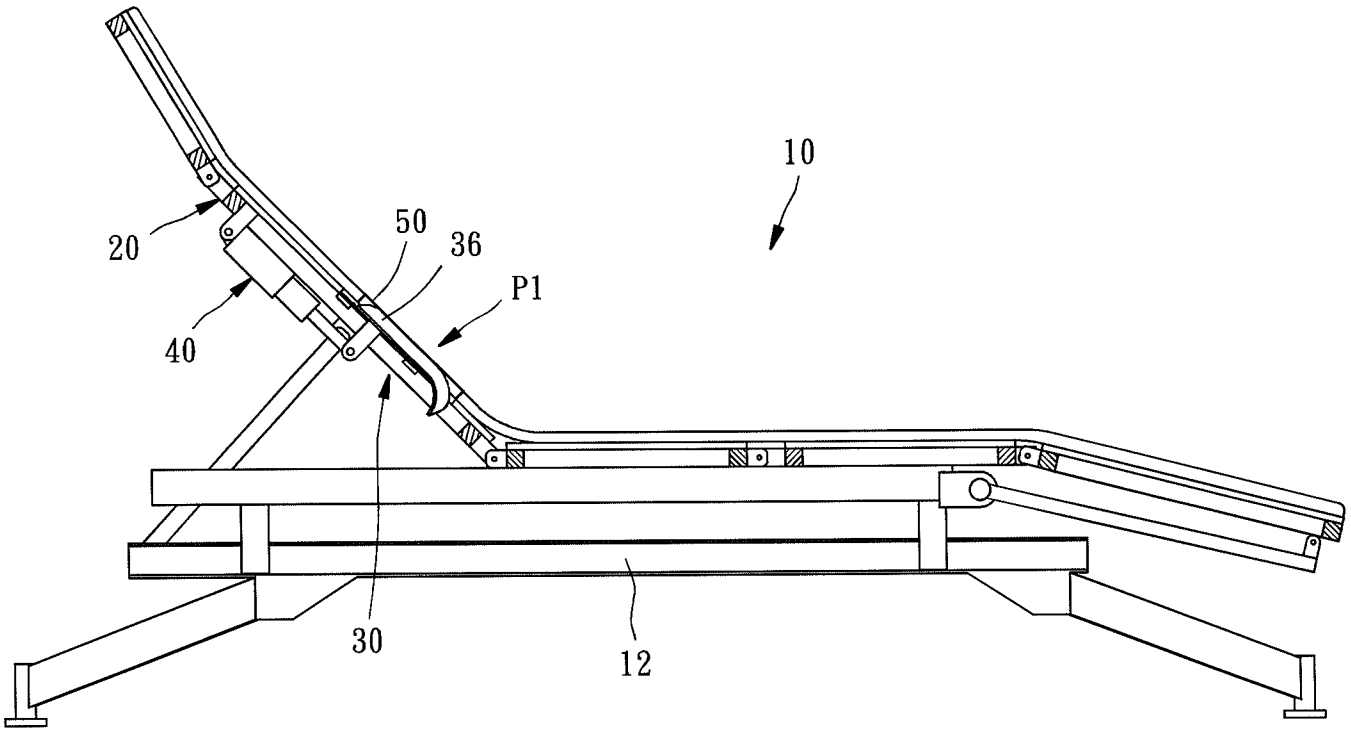
FIG. 1 is a cross-sectional view of an electric bed according to a first preferred embodiment of the present invention, showing that the waist supporting device is stopped at a first position.
Figure 2:
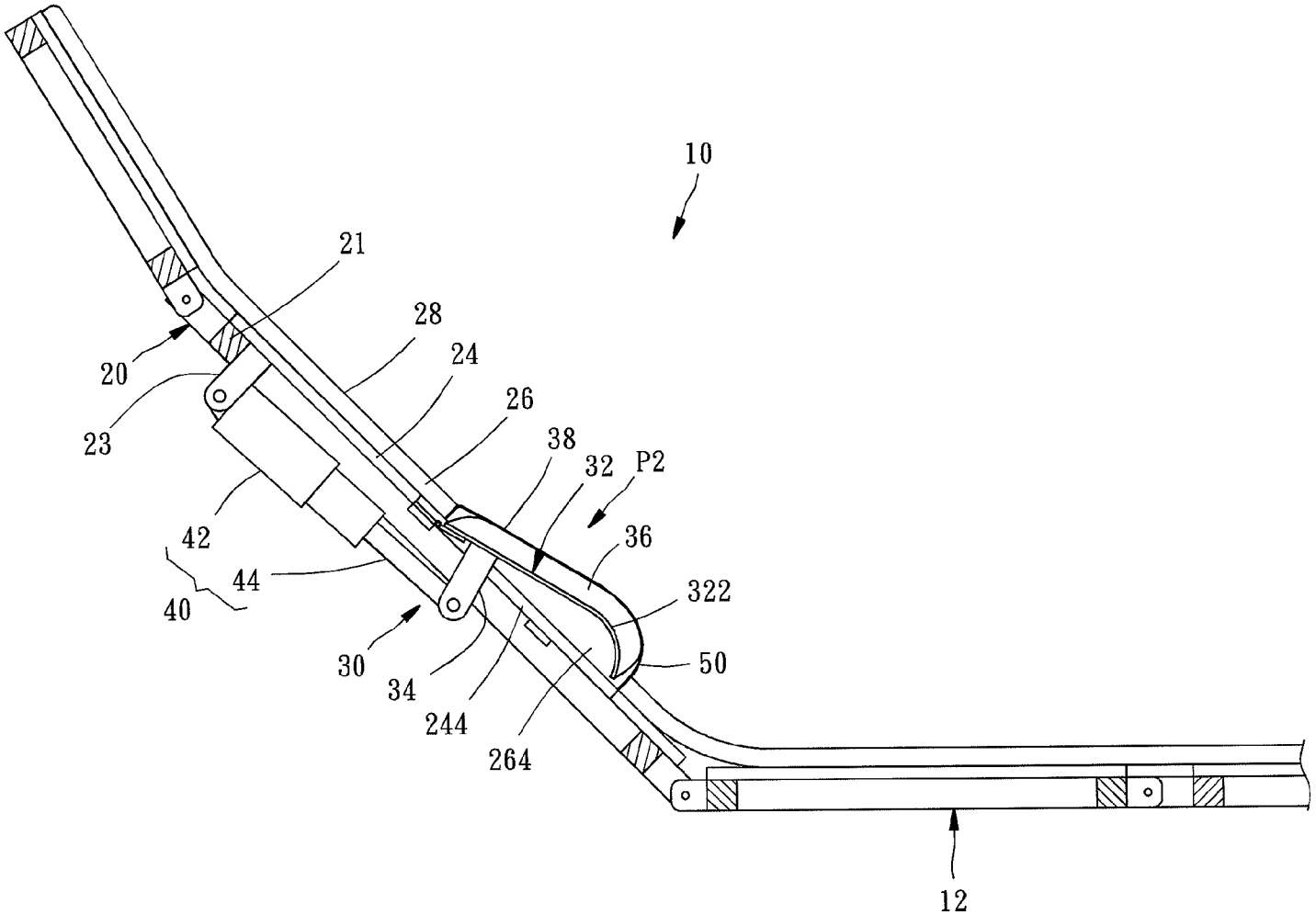
FIG. 2 is a partially cross-sectional view of the electric bed of the first preferred embodiment of the present invention, showing that the waist supporting device is swiveled to a second position.
Figure 3:
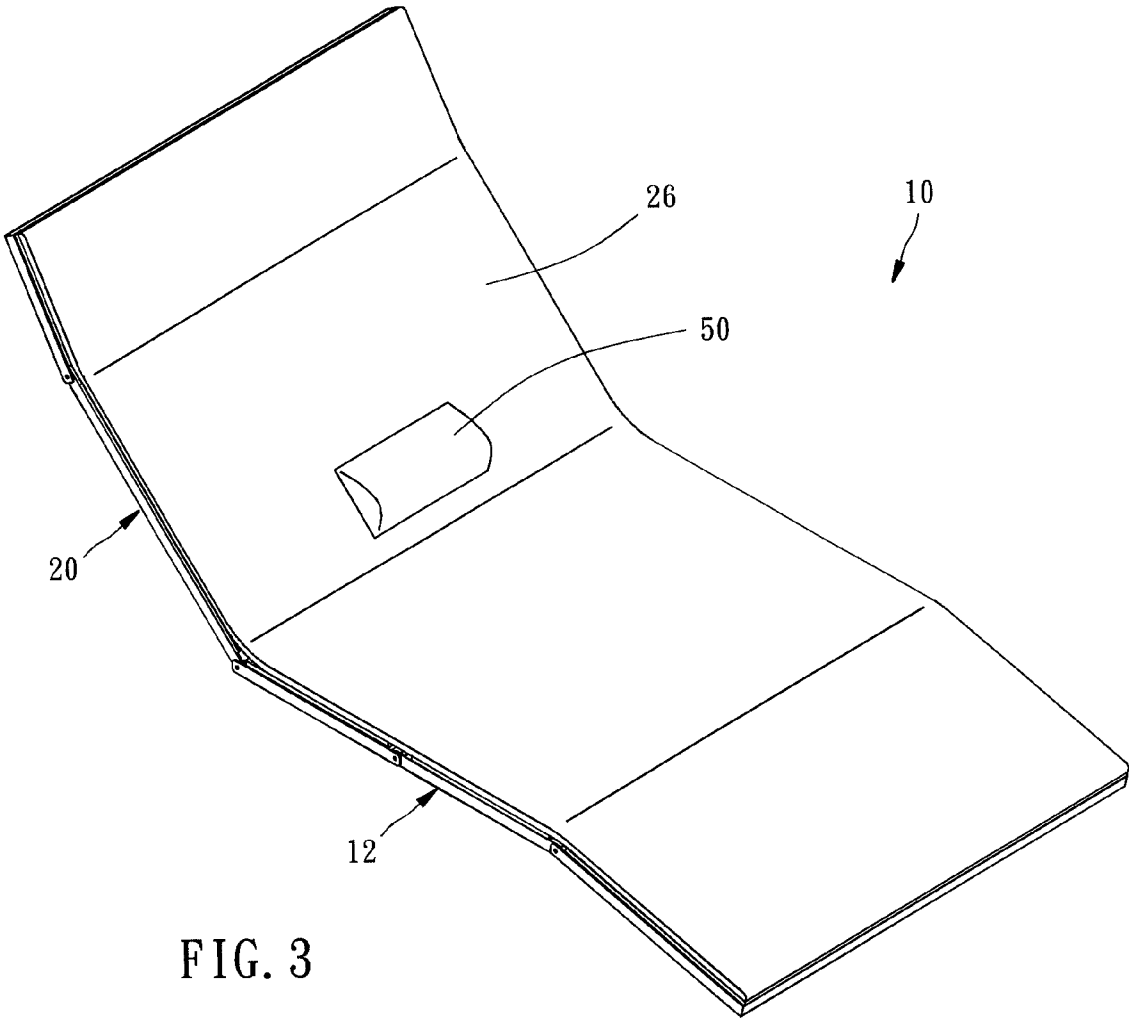
FIG. 3 is a perspective view showing a part of the electric bed of the first preferred embodiment of the present invention, in which the waist supporting device is stopped at the second position.

As shown in FIGS. 1-3, an electric apparatus for lying and/or sitting provided by a first preferred embodiment of the present invention is exemplified as an electric bed 10 in this embodiment. The electric bed 10 comprises a seat 12, a back frame 20, a waist supporting device 30, an actuator 40 and a cover layer 50.

The back frame 20 is moveably mounted on the seat 12 for supporting a user's back. The back frame 20 includes a frame body 21, a connector 23 downwardly extending from the frame body 21, a plate 24 mounted on the frame body 21 and provided with a hollow portion 244 corresponding to the waist supporting device 30, and a cushion pad 26 mounted on the plate 24 and provided with a hollow portion 264 correspond to the waist supporting device 30.

The waist supporting device 30 includes a plate 32, a connector 34 and a cushion pad 36. The plate 32 has an end pivotally connected with the back frame 20 and a free end provided with a curved portion 322. The connector 34 protrudes downwardly from the plate 32. The cushion pad 36 is mounted on the plate 32 and covers over the plate 32, such that the cushion pad 36 also has a curved portion corresponding in configuration to the curved portion 322 of the plate 32.

For the actuator 40, any actuator that can do a reciprocally linear motion can be used. For example, a hydraulic actuator or a pneumatic actuator can be used as the actuator 40 of the present invention. In this preferred embodiment, the actuator 40 comprises a cylinder 42 with a fixation end pivotally connected with the connector 23 of the back frame 20, and an output shaft 44 with a reciprocally retractable end pivotally connected with the connector 34 of the waist supporting device 30. It will be appreciated that the cylinder 42 can be installed in a way that the fixation end thereof is pivotally connected with the connector 34 of the waist supporting device 30, and in this case, the retractable end of the output shaft 44 is pivotally connected with the connector 23 of the back frame 20.

The waist supporting device 30 is drivenable by the actuator 40 to swivel between a first position P1 as shown in FIG. 1 and a second position P2 as shown in FIG. 2. When the waist supporting device 30 is stayed at the first position P1, a top surface 38 of the waist supporting device 30 is substantially flush with the top surface 28 of the back frame 20. When the waist supporting device 30 is stayed at the second position P2, most parts of the cushion pad 36 and the curved portion 322 of the plate 32 protrude over the top surface 28 of the back frame 20.

Figure 4:
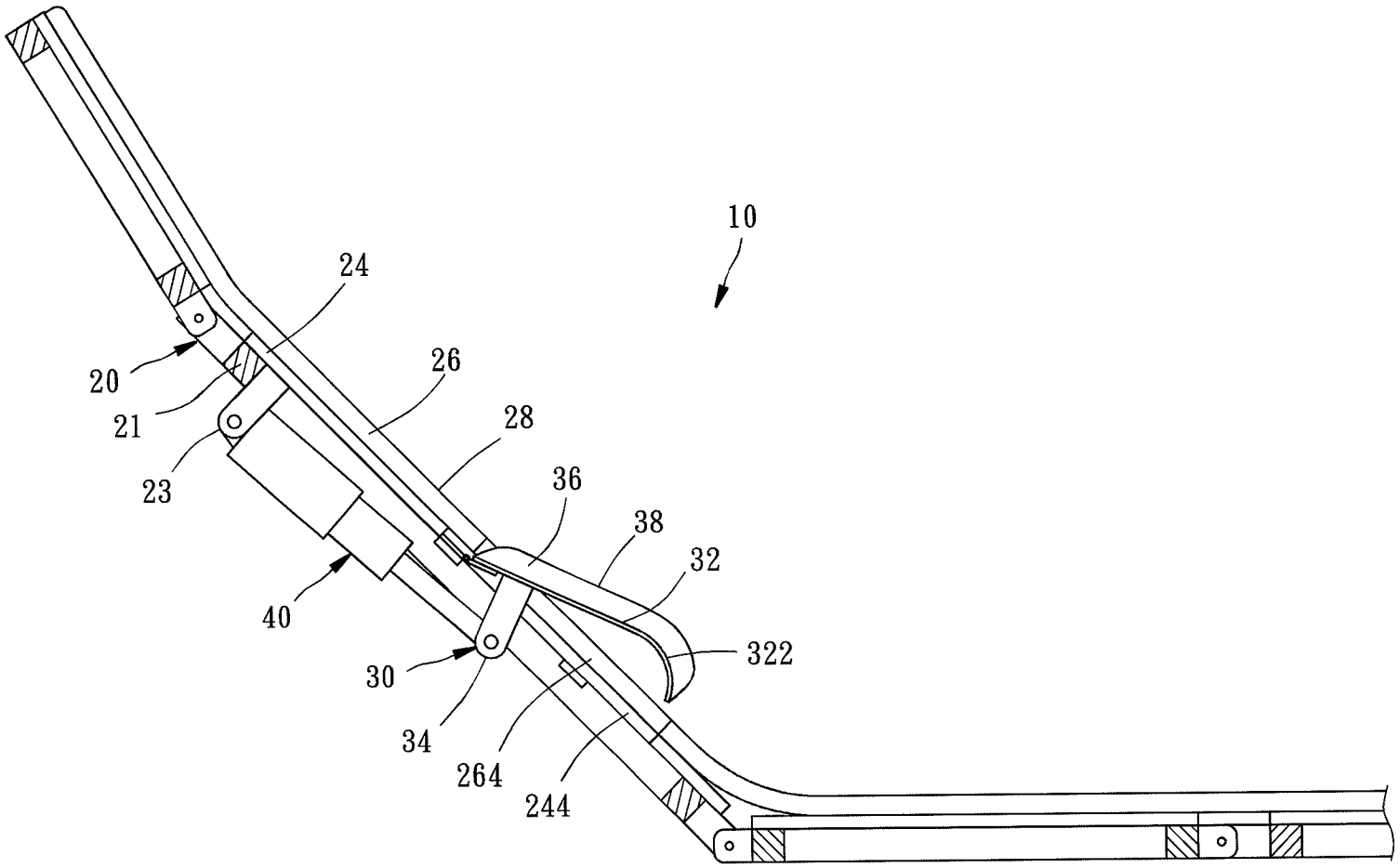
FIG. 4 is a partially cross-sectional view of an electric bed according to a second preferred embodiment of the present invention.

The cover layer 50 is a resilient thin cloth provided on the top surface 28 of the back frame 20 and covering over the hollow portions 244 and 264, thereby preventing an injury of a user's body due to the entrance of the user's body into the gap between the waist supporting device 30 and the back frame 20 and providing a smooth appearance for the electric bed 10. However, as shown in FIG. 4 that illustrates a second preferred embodiment of the present invention, the electric bed 10 may have no such cover layer 50.

According to the structure of the electric bed 10 provided by the present invention, the waist supporting device 30 that is stayed at the second position P2 can support the user's waist so as to make the user feel comfortable when the user lies or sits down on the electric bed 10. To forgo the service of the waist supporting device 30, the waist supporting device 30 is swiveled to the first position P1 by controlling the actuator 40. Further, the electric bed 10 of the present invention may be designed in such a way that the waist supporting device 30 can be swiveled to and stopped at any position between the first and second positions P1 and P2 in addition to the first position P1 and the second position P2. In this way, the user can adjust the elevation of the waist supporting device 30, which protrudes over the top surface 28 of the back frame 20, so as to adjust the waist supporting effect of the waist supporting device 30.

In the aforesaid embodiments of the present invention, the top surface 38 of the waist supporting device 30 is set to be flush with the top surface 28 of the back frame 20 when the waist supporting device 30 is stayed at the first position P1; however, the top surface 38 can be positioned not to be flush with the top surface 28 of the back frame 20 when the waist supporting device 30 is stopped at the position P1. For example, the top surface 38 of the waist supporting device 30 can be positioned at an elevation slightly protruding over the top surface 28 of the back frame 20 when the waist supporting device 30 is stopped at the so-called first position P1, such that the waist supporting device 30 can provide an elementary supporting effect at its initial stage. On the other hand, the back frame 20 may not comprise the plate 24, and in this case the cushion pad 26 is directly mounted on the frame body 21. Further, the cushion pad 26 can be eliminated, and in this case the user can directly put an existing mattress or chair pad in home on the frame body 21. Furthermore, the plate 32 of the waist supporting device 30 may be configured without the curved portion 322 or having a specific profile as long as the configuration of the plate 32 will not cause any discomfort to the user.

Figure 5:
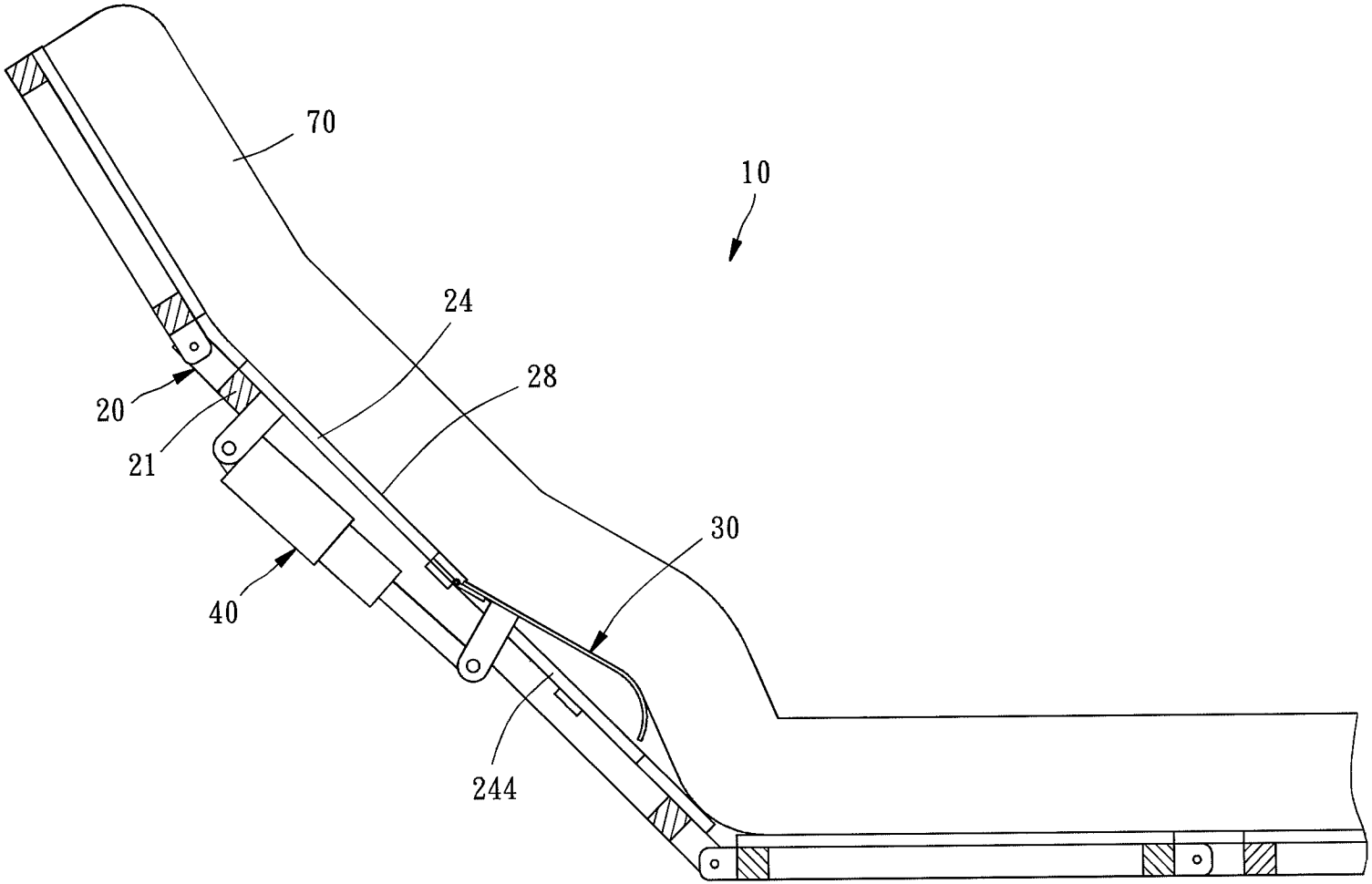
FIG. 5 is a partially cross-sectional view of an electric bed according to a third preferred embodiment of the present invention.

The back frame 20 may comprise no cushion pad 26, and in this case the top surface 28 of the back frame 20 will be referred to the top surface of the plate 24. Similarly, the waist supporting device 30 may comprise no cushion pad 36, and in this case the top surface of the waist supporting device 30 will be the top surface of the plate 32. Alternatively, as illustrated in FIG. 5 that shows an electric bed of a third preferred embodiment of the present invention, the back frame 20 and the waist supporting device 30 do not provide cushion pads respectively. In either aforesaid ways, the waist supporting device 30 can still provide a waist supporting effect as along as the waist supporting device 30 protrudes over the 'top surface' of the back frame 20 when it is stopped at the second position P2.

The electric bed 10 having none of cushion pads 26 and 36 may provide less comfort; however, this problem can be solved by the user by putting a mattress 70, as shown in FIG. 5, on the back frame 20. The material, pattern and thickness of the mattress 70 are not limited as long as the mattress 70 can protrude to support the user's waist when the waist supporting device 30 is stopped at the second position P2.

While the aforesaid preferred embodiments of the present invention are exemplified as an electric bed which allows the user to lie down flat or sit down when the back frame is folded upward and inclinedly, the technical features disclosed by the present invention can also be applied to any kinds of apparatus for lying and/or sitting, including, but not limited to, a chair having a fixed back and a chair having an inclination adjustable back, so as to constitute an electric bed, chair and the like having a waist supporting device.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An electric apparatus for lying and/or sitting, comprising:

a seat;

a back frame comprising a frame body having a top surface, the back frame mounted to the seat and moveable with respect to the seat between a flat position and an inclined position;

a waist supporting device comprising a plate comprising:

a pivot end pivotally attached to the top surface of the frame body; and a free end opposite the pivot end, the pivot end disposed between the free end and a head of the electric apparatus; and an actuator comprising:

a fixation end pivotally and directly connected with one of the frame body and the plate of the waist supporting device between the pivot end and the free end; and a reciprocally retractable end pivotally and directly connected with the other one of the frame body and the plate of the waist supporting device between the pivot end and the free end, such that the waist supporting device is pivotable by the actuator about the pivot end between a first position where the free end is adjacent the top surface and a second position where the free end protrudes from the top surface of the frame body, the waist supporting device positionable in the second position to provide waist support with the back frame in either the flat position or the inclined position, wherein when the waist supporting device is in the first position and the back frame is in either the flat position or the inclined position, a waist supporting device top surface is flush with a back frame top surface.

2. The electric apparatus of claim 1, wherein the waist supporting device further comprises a cushion pad mounted on the plate.

3. The electric apparatus of claim 1, wherein the free end of the plate of the waist supporting device comprises a curved portion.

4. The electric apparatus of claim 1, wherein the back frame further comprises a cushion pad mounted on the frame body.

5. The electric apparatus of claim 4, wherein the cushion pad has a hollow portion corresponding to the waist supporting device.

6. The electric apparatus of claim 5, wherein a cover layer is provided on the cushion pad of the back frame and covers over the hollow portion of the cushion pad.

7. The electric apparatus of claim 4, wherein the back frame further comprises a plate disposed between the frame body and the cushion pad and provided with a hollow portion corresponding to the waist supporting device.

8. The electric apparatus of claim 1, wherein the back frame further comprises a back frameplate mounted on the frame body and provided with a hollow portion corresponding to the waist supporting device.

9. The electric apparatus of claim 1, wherein the back frame further comprises a back frame connector attached to the frame body and extending from the frame body in a direction opposite the top surface of the frame body, the back frame connector pivotally connected with the actuator.

10. The electric apparatus of claim 1, wherein the actuator comprises a cylinder pivotally connected with the frame body, and an output shaft pivotally connected with the plate of the waist support device between the pivot end and the free end.

11. The electric apparatus of claim 1, wherein the actuator comprises a cylinder pivotally connected with the plate of the waist supporting device between the pivot end and the free end, and an output shaft pivotally connected with the frame body.

12. The electric apparatus of claim 1, wherein:

the plate of the waist supporting device comprises:

a bottom surface in contact with the top surface of the frame body when the waist supporting device is in the first position; and a waist supporting device connector fixedly mounted on the bottom surface of the plate, extending perpendicularly from the bottom surface and pivotally connected with the actuator.

13. The electric apparatus of claim 12, wherein the waist supporting device connector extends completely through the frame body.

14. The electric apparatus of claim 12, wherein the waist supporting device connector is mounted on the bottom surface of the plate closer to the pivot end than the free end.

* * * * *